US005538661A

United States Patent [19]

Dawson et al.

[11] Patent Number: 5,538,661

[45] Date of Patent: Jul. 23, 1996

[54] ESTER LUBRICANTS

[75] Inventors: Raymond B. Dawson; Hugh A. Fisher; Kenneth C. Lilje; Mahmood Sabahi, all of Baton Rouge, La.

[73] Assignee: Albemarle Corporation, Richmond, Va.

[21] Appl. No.: 285,587

[22] Filed: Aug. 3, 1994

Related U.S. Application Data

[63] Continuation of Ser. No. 34,951, Mar. 22, 1993, abandoned.

[51] Int. Cl.[6] ..... C09K 5/04; C10M 129/72; C10M 105/36

[52] U.S. Cl. ..... 252/68; 252/67; 508/462; 508/485; 508/496

[58] Field of Search ..... 252/68, 67, 56 R, 252/56 S

[56] References Cited

U.S. PATENT DOCUMENTS

| | | | |
|---|---|---|---|
| 4,812,262 | 3/1989 | Shinzawa et al. | 252/579 |
| 5,021,179 | 6/1991 | Zehler et al. | 252/54.6 |
| 5,064,547 | 11/1991 | Rubin | 252/56 R |
| 5,391,312 | 2/1995 | Senaratne et al. . | |
| 5,399,279 | 3/1995 | Sabahi et al. . | |

FOREIGN PATENT DOCUMENTS

| | | |
|---|---|---|
| 0430657 | 6/1991 | European Pat. Off. . |
| 2-38578 | 8/1990 | Japan . |
| 90/12849 | 11/1990 | WIPO . |

*Primary Examiner*—Christine Skane
*Attorney, Agent, or Firm*—Philip M. Pippenger

[57] ABSTRACT

An ester oil which lacks complete miscibility with fluorohydrocarbons has its miscibility with fluorohydrocarbons refrigerants improved by blending it with a second ester oil composed of molecules corresponding to the formula $ROOC—CH_2CH_2\text{-}[(ROOC)CHCH_2]_m—C(COOR)_2—[CH_2CH(COOR)]_n—CH_2CH_2COOR$ wherein the R's represent alkyl groups of 1–30 carbons, at least 10% of which are alkyl groups of 1–4 carbons; and each of m and n represents zero or a positive integer such that the sum of m and n in a molecule is 0–30.

13 Claims, No Drawings

ESTER LUBRICANTS

This application is a continuation of application Ser. No. 08/034,951, filed Mar. 22, 1993 now abandoned.

FIELD OF INVENTION

This invention relates to ester lubricants and more particularly to ester oil mixtures useful as refrigeration lubricants.

BACKGROUND

Many natural and synthetic materials are known to be useful as lubricants, their utility in particular applications depending on factors such as their stability and viscosity under the conditions of use, their pour points, and their compatibility with any materials with which they will be used. Among these known materials are ester oils, such as alkyl alkanoates, alkyl diesters of aliphatic and aromatic dicarboxylic acids, and fatty acid esters of neopolyols.

In refrigeration applications (e.g., home-use or industrial-use refrigerators, freezers, or air conditioners for buildings, automobiles, airplanes, and other vehicles), the need to replace chlorofluorocarbon refrigerants with a refrigerant having lesser ozone-depleting potential has made it important to find lubricants which would be suitable for use with fluorohydrocarbons—especially 1,1,1,2-tetrafluoroethane (R-134a), a refrigerant that has been reported to have an ozone depletion potential of zero. Mineral oils, usually the refrigeration lubricants of choice in the past, cannot be utilized in this application because of incompatibility with such refrigerants.

It would be desirable to be able to employ the aforementioned ester oils as lubricants in refrigeration compositions containing fluorohydrocarbons. However, a criterion for lubricants in such compositions is complete miscibility with R-134a over the entire temperature range to which the compositions are apt to be exposed in refrigeration equipment (generally temperatures in the range of about −40° C. to 70° C.), and many of these ester oils lack that miscibility—at least when used in an amount such as to provide the fluorohydrocarbon/ester oil weight ratio at which it is usually believed to be most important for complete miscibility to be achieved, i.e. 4/1.

Copending applications Ser. No. 07/947,628 (Sabahi) and Ser. No. 07/986,204 (Sabahi et al.) teach ester oils which have excellent miscibility with refrigerants, including R-134a and other fluorohydrocarbons, and are useful as lubricants in refrigeration compositions containing them. These novel lubricants are oils composed of molecules corresponding to the formula $ROOC—CH_2CH_2—[(ROOC-)CHCH_2]_m—C(COOR)_2—[CH_2CH—(COOR)]_n—CH_2CH_2COOR$ in which the R's represent alkyl groups of 1–30 carbons, at least 10% of which are alkyl groups of 1–4 carbons, and each of m and n represents zero or a positive integer such that the sum of m and n in a molecule is 0–30, preferably 0–10.

SUMMARY OF THE INVENTION

It has now been found that an ester oil which lacks complete miscibility with fluorohydrocarbons can be made more miscible with a refrigerant comprising a fluorohydrocarbon by blending it with a miscibility-improving amount of an ester oil composed of molecules corresponding to the formula $ROOC—CH_2CH_2—[(ROOC)CH—CH_2]_m—C(COOR)_2[CH_2CH(COOR)]_n—CH_2CH_2COOR$ in which the R's represent alkyl groups of 1–30 carbons, at least 10% of which are alkyl groups of 1–4 carbons; and each of m and n represents zero or a positive integer such that the sum of m and n in a molecule is 0–30.

DETAILED DESCRIPTION

Ester oils which may have their refrigerant-miscibility improved in accordance with the present invention include those which are completely immiscible with fluorohydrocarbons in any proportions, those which are miscible with fluorohydrocarbons only when used in very small amounts, and those which have desirable miscibility over only part of the temperature range to which a refrigeration composition is apt to be exposed. As already indicated, these first ester oils of the novel compositions are known materials which are apt to be available commercially and have sometimes been found to be suitable for use in applications wherein their limited miscibility with fluorohydrocarbons has not been a detriment.

Most commonly, the first ester oils are selected from oily (1) alkyl alkanoates. (2) alkyl diesters of aliphatic and aromatic dicarboxylic acids, (3) higher fatty acid esters of neopolyols, and (4) mixtures thereof with one another and/or with ester oils that are miscible with fluorohydrocarbons by themselves, which ester oils are immiscible or only partly miscible with fluorohydrocarbons. However, other ester oils lacking the desired miscibility, e.g., diol esters and carbonate esters, may also have their fluoro-hydrocarbon-miscibility improved by the practice of the invention.

As is known, alkyl alkanoate oils are compounds in which the alkyl moieties usually contain 1–30 carbons, while the alkanoic moieties are most apt to contain 1–20 carbons—the particular alkyl and alkanoic moieties combined with one another in any such compound being such as to give it an oily character. Typically, the alkyl alkanoates are compounds in which the alkyl groups contain 6–30, preferably 8–12, and more preferably 8–10 carbons, e.g., hexyl, heptyl, octyl, isooctyl, 2-ethylhexyl, nonyl, decyl, isodecyl, dodecyl, tetradecyl, hexadecyl, octadecyl, eicosyl, docosyl, tetracosyl, or triacontyl groups. However, they may be compounds in which the alkyl groups are smaller, e.g., methyl, ethyl, propyl, isopropyl, butyl, or pentyl, when the alkanoic moiety contains a chain of sufficient length (usually at least six carbons) to make the compounds oils. The alkanoic moieties of these oils ordinarily contain 1–20 carbons and may be, e.g., formic, acetic, propionic, butyric, pentanoic, hexanoic, heptanoic, octanoic, decanoic, laurie, myristic, palmitic, stearic, or eicosanic groups.

The alkyl diesters are generally phthalates or adipates in which the esterifying groups may be the same or different and are usually alkyl groups containing 4–18 carbons, preferably 8–12, and more preferably 8–10 carbons, e.g., butyl, pentyl, hexyl, heptyl, octyl, isooctyl, 2-ethylhexyl, nonyl, decyl, isodecyl, dodecyl, tetradecyl, hexadecyl, or octadecyl groups. However, the corresponding esters of other aliphatic and aromatic dicarboxylic acids, such as azelaic, sebacic, isophthalic, and terephthalic acids, are also utilizable.

When a fatty acid ester of a neopolyol is employed, it is usually an ester of at least one alkanoic acid containing 8–20 carbons (e.g., octanoic, decanoic, lauric, myristic, palmitic, stearic, or eicosanic acid ) with a neopolyol such as pentaerythritol, dipentaerythritol, trimethylolethane, trimethylolpropane, neopentyl glycol, or other polyhydric alcohol containing at least one quaternary carbon. However, the invention also has utility in improving the miscibility of any neopolyol ester which is normally immiscible or only partially miscible with fluorohydrocarbons, including those obtained by esterifying the neopolyol with a mixture of one or more of the higher alkanoic acids mentioned above and one or more lower alkanoic acids, such as acetic, propionic, butyric, pentanoic, hexanoic, and heptanoic acids.

The second ester oil, which is employed in a miscibility-improving amount, may be any ester oil composed of molecules corresponding to the formula $ROOC—CH_2CH_2—[(ROOC)CHCH_2]_m—C(COOR)_2—[CH_2CH(COOR)]_n—CH_2CH_2COOR$ in which the R's represent alkyl groups of 1–30 carbons, at least 10% of which are alkyl groups of 1–4 carbons; and each of m and n represents zero or a positive integer such that the sum of m and n in a molecule is 0–30. However, it is preferably such an oil in which the sum of m and n in the molecules is an average of 1–10. As already indicated, these second ester oils are disclosed in Sabahi, the teachings of which are incorporated herein by reference.

Essentially, the second ester oils are compounds or mixtures which may be obtained by reacting suitable Michael donors and Michael acceptors and then, if desired, subjecting the products to post-treatments, such as transesterification. When produced directly by a Michael reaction, they are synthesized by reacting one or more dialkyl malonates with one or more alkyl acrylates selected so that the product contains at least the required number of lower alkyl groups. However, the lubricants may also be prepared by forming such a Michael product and then subjecting it to a transesterification reaction in which some of the lower alkyl groups are replaced with higher alkyl groups.

Michael donors and Michael acceptors which can be used in the reaction include all dialkyl malonates and alkyl acrylates in which the alkyl groups contain 1–30 carbons, although (1) the donors which are sufficiently reactive to permit a reasonably fast reaction are apt to be preferred and (2) it is, of course, necessary for at least one of the reactants to contain alkyl groups of 1–4 carbons. The alkyl groups in such compounds are preferably true alkyl groups (i.e., saturated aliphatic hydrocarbyl groups), such as methyl, ethyl, propyl, isopropyl butyl, isobutyl, t-butyl, pentyl, hexyl, heptyl, octyl, decyl, dodecyl, tetradecyl, hexadecyl, octadecyl, eicosyl, docosyl, tetracosyl, and triacontyl groups, more preferably those containing 1–10 carbons, and most preferably methyl and/or ethyl groups. However, they may also be groups which are predominantly alkyl in nature, i.e., contain one or more atoms other than the carbon and hydrogen of the alkyl groups as hetero atoms (e.g., oxygen, sulfur, or phosphorus atoms) which are part of the chain or as substituent groups (e.g., alkoxy, halo, or cyano groups) but contain so few of the other atoms that the predominantly hydrocarbyl nature of the groups is preserved.

To preserve the predominantly hydrocarbyl nature of the group, the number of hetero atoms or non-hydrocarbyl substituents therein should not exceed 0.3 per carbon and is preferably not more than 0.1 per carbon. These predominantly hydrocarbyl groups can be regarded as being virtually the same as the alkyl groups to which they most closely correspond, so the term alkyl, as used herein, should be understood as including the predominantly alkyl groups as well as the alkyl groups normally denoted by those terms. Exemplary of such groups are chlorohexyl, bromodecyl, ethoxyoctyl, and cyanononyl.

As in Sabahi, it is generally preferred to prepare the Michael product by reacting the donor and acceptor in the presence of a basic initiator (preferably an alkali or alkaline earth metal hydroxide, alkoxide, amide, or carbonate) and a phase transfer catalyst (preferably an alkylammonium salt such as the tetraalkylammonium chlorides, bromides, fluorides, iodides, sulfates, hydrogen sulfates, carbonates, and phosphates in which the alkyl groups contain 1–20 carbons) at a suitable temperature, usually a temperature of about 0°–150° C., preferably about 20°–120° C., and most preferably about 60°–110° C.

The reaction is effected by combining the reactants, initiator, and catalyst, optionally in the presence of a solvent, and maintaining contact between the reactants at the selected reaction temperature until the desired degree of reaction has been effected. It is usually preferred to make the Michael acceptor the last of the ingredients to be charged to the reaction vessel in order to achieve better control of the reaction temperature and hence improved direction of the reaction to the formation of a desired product.

Since the reaction normally leads to the formation of a mixture of products containing different numbers of acceptor moieties per molecule, it permits the production of some molecules containing more acceptor moieties than the number that would theoretically be provided by the amount of acceptor employed in the reaction mixture. However, it is necessary for the reaction mixture to contain at least the stoichiometric requirement of the acceptor, and preferably a stoichiometric excess, in order for the product to contain a substantial amount of a desired product molecule. Thus, since the oils having optimum viscosities are usually those in which the molecules contain 1–30, preferably about 1–10 acceptor moieties/donor moiety, it is generally preferred for the acceptor/donor mol ratio in the reaction mixture to be about 1–35/1, more preferably about 1–15/1. Particularly preferred lubricants of the invention are ester oils which are prepared so as to have at least three acceptor molecules in at least about 25% of the molecules obtained by the Michael reaction.

The products of the Michael reaction may be liquids or solids, depending on the particular reactants and reactant ratios used; and, as already indicated, they are typically mixtures of compounds containing different numbers of acceptor moieties per molecule. If desired, the individual compounds of the mixture or groups of those compounds (e.g., the relatively low and relatively high molecular weight fractions) may be separated from one another prior to being used in their end application or prior to being subjected to transesterification preparatory to such use. However, such separations are frequently unnecessary and, in fact, sometimes undesirable. Having a product characterized by a wide molecular weight distribution can be an advantage in providing a balance of properties, as is the case with oils which are to be used in refrigeration compositions wherein some relatively high molecular weight portion is desired to give a required viscosity, but some relatively low molecular weight portion is desired to increase compatibility with the refrigerant with which the oil is to be used.

Achieving either a better balance of properties or properties which differ in some other respect from those of the Michael reaction product can also be accomplished by subjecting the product mixture or one or more of the components thereof to transesterification. Such a post-treatment of the Michael product is particularly beneficial in providing products containing ester groups which—if present in one or more of the Michael reactants—would make the reaction relatively slow. Thus, it is apt to be preferred, for example, to react dimethyl malonate with methyl acrylate to provide a first product and then transesterify that product with hexanol to provide an oily second product in which about a third of the functional groups are hexyl ester groups than to prepare an oily Michael reaction product from the slower-reacting dihexyl malonate and methyl acrylate.

Regardless of whether the transesterification is conducted on a recovered or unrecovered intermediate, it is accomplished by contacting the intermediate with one or more alcohols containing more carbons per molecule than the alkyl groups to be replaced and maintaining contact between the reactants at a suitable temperature until the desired transesterification has been effected. Alcohols most apt to be desirable for use in the reaction are substituted and unsubstituted alkanols containing up to about 30 carbons (e.g., ethanol, chloroethanol, propanol, butanol, hexanol, bromohexanol, heptanol, octanol, decanol, fluorodecanol, dodecanol, hexadecanol, octadecanol, eicosanol, tetracosanol, triacontanol, and mixtures thereof), as well as the aliphatic alcohols containing up to 30 carbons and also containing hetero atoms, such as oxygen, phosphorus, or sulfur (e.g., ethylthioethanol, ethoxyethanol, and the like).

The amount of alcohol employed in the transesterification reaction varies with the degree of transesterification desired, the quantity generally being the stoichiometric amount or an amount slightly in excess of the stoichiometric requirement. For example, when the intermediate contains an average of four ester groups per molecule, and the degree of transesterification desired is 75%, the amount of alcohol added to the intermediate should be three mols or slightly more than three mols/mol of intermediate. Only about two-thirds as much alcohol would be added, on the other hand, when the desired degree of transesterification is about 50%.

As indicated in Sabahi, the use of a transesterification process in preparing the lubricants is a particularly desirable method of producing lubricants having higher viscosities, since one of the factors determining the viscosity is the chain lengths of the alkyl groups. However, when an alcohol employed in the process contains higher alkyl groups, e.g., alkyls of 6–30 carbons, it is important to avoid replacing too many of the lower alkyl groups. Whether the lubricants are prepared directly by a Michael reaction or by the transesterification of a Michael product, at least 10%, preferably at least 20%, and more preferably at least 50% of the alkyl groups must contain only 1–4 carbons if the lubricants are to have the desired miscibility with fluorohydrocarbon refrigerants.

Use of a transesterification reaction after completion of the Michael reaction permits a wide variety of products to be prepared from any particular product of the Michael reaction. The transesterification is suitably conducted in the presence or absence of a basic catalyst at an elevated temperature which provides for reflux and removal of a lower alcohol by-product from the reaction mixture without permitting undue loss of the higher alcohol reactant(s) from the reaction vessel, e.g, a temperature of about 50°–180° C.

The products resulting from the Michael reaction or from conversion of the Michael reaction products to transesterified derivatives are typically washed with water to remove any unreacted materials and catalyst prior to being used in their intended application; and, if desired, they may then be further purified by subjecting them to fractional distillation.

The refrigeration lubricants of the invention are ester oil mixtures containing the first ester oil and a miscibility-improving amount of the second ester oil—the amount of second oil required to improve the fluorohydrocarbon miscibility of the first oil varying with the degree of fluorohydrocarbon miscibility that the first oil has by itself. Ordinarily the constituent oils are used in proportions such as to provide a second ester oil/first ester oil weight ratio of at least about 0.05/1, and that ratio is most commonly at least 0.1/1. The preferred second ester oil/first ester oil weight ratios are 0.5–5.0/1, more preferably 1–5/1.

As is known, (1) a lubricant to be used with any refrigerant should have a viscosity such as to permit its functioning as a lubricant throughout the temperature range to which the refrigeration composition is to be exposed, typically temperatures in the range of about –40° C. to 70° C. or sometimes even higher temperatures, (2) viscosities suitable for such lubricants are apt to be 1–600, preferably 5–300, and most preferably 10–200 $mm^2 \cdot s^{-1}$ at 40° C., (3) it is frequently also desirable for the lubricant to have a viscosity index$\geqq$100, but (4) the viscosity most desirable for the lubricant varies with factors such as the particular temperatures to which it will be exposed— a low viscosity being most suitable for a lubricant to be used at relatively low temperatures, while a higher viscosity is more appropriate for lubricants intended for use at relatively high temperatures. Thus, the particular second ester oil which is the optimum one to blend with the first ester oil in order to improve its fluorohydrocarbon miscibility can vary with the viscosity desired for the lubricant—the oils having the larger number of long side-chains, higher molecular weights, and wider molecular weight distributions ordinarily being the most viscous.

The fluorohydrocarbon refrigerants with which the novel lubricant mixtures are most advantageously employed are refrigerants consisting of one or more fluorohydrocarbons, such as difluoromethane (R-32), 1,1,2,2,2-pentafluoroethane (R-125), 1,2,2-tetrafluoroethane (R-134), 1,1,1,2-tetrafluoroethane (R-134a), 1,1,1-trifluoroethane (R-143a), and 1,1-difluoroethane (R-152a). Alternatively, they may be mixtures of one or more fluorohydrocarbons with one or more other refrigerants, e.g., hydrocarbons such as methane, ethane, propane (R-290), butane, ethylene, and propylene; and halocarbons and/or halohydrocarbons such as chlorotrifluoromethane, dichlorodifluoromethane, dichlorofluoromethane, chlorodifluoromethane (R-22), 1,2,2-trifluoro-1,1,2-trichloroethane, 1,1-dichloro-2,2,2-trifluoroethane (R-123), 1,1-dichloro- 1-fluoroethane, 1-chloro-2,2,2-trifluoroethane, 1-chloro-1,2,2,2-tetrafluoroethane (R-124), 1-chloro-1,1,2,2-tetrafluoroethane, and dichloromethane. Among the refrigerant blends with which the lubricants can be beneficially used are the binary mixtures of R-32 with R-125, R-152a, or R-134a; R-125/R-143a, R-290/R-134a, and R-22/R-152a binary blends; and ternary blends such as R-22/R-290/R-125, R-22/R-152a/R-124, R-32/R- 125/R-134a, and R-125/R-143a/R-134a.

Refrigeration compositions of the invention typically comprise 0.001–1, preferably 0.1–1 part of the novel lubricant per part by weight of the refrigerant, and, if desired, they may also contain additives of the type conventionally used in refrigeration lubricants. In addition to epoxy and other dehydrating agents sometimes employed to prevent corrosion of refrigeration equipment by any water in the refrigeration compositions, such additives include, e.g., oxidation resistance and thermal stability improvers, corrosion inhibitors, metal deactivators, lubricity additives, viscosity index improvers, pour and/or floc point depressants, detergents, dispersants, antifoaming agents, anti-wear agents, and extreme pressure resistance additives, such as those exemplified in U.S. Pat. No. 5,021,179 (Zehler et al.), the teachings of which are incorporated herein by reference. As in Zehler et al., these additives, when employed, are generally utilized in small amounts totaling not more than 8%, preferably not more than 5%, of the weight of the lubricant formulation.

The refrigeration compositions are generally formed prior to use. However, when desired, they may also be formed in situ during operation of the refrigeration equipment. Thus, the refrigerant and the lubricant may be charged to the refrigeration equipment separately, either simultaneously or consecutively in either order, instead of being preblended.

The invention is advantageous in that it improves the fluorohydrocarbon-miscibility of the first ester oils to the extent that ( 1 ) the ester oils which are completely immisible with fluorohydrocarbons even at temperatures as high as 70° C. can actually be used as lubricants in refrigeration compositions containing fluorohydrocarbons and (2) the ester oils which are ordinarily miscible with fluorohydrocarbons only at the higher temperatures to which a refrigeration composition is apt to be exposed can be made miscible at temperatures down to –40° C. and sometimes even lower.

The following examples are given to illustrate the invention and are not intended as a limitation thereof. Unless otherwise specified, quantities mentioned in these examples are quantities by weight.

EXAMPLE 1

Preparation of malonate/acrylate oil (PBE-25)

Charge a reaction vessel with 15.8 Kg (120 mols) of dimethyl malonate, 158 g (1.2 mols) of potassium carbonate, and 37 g (0.1 mol) of tetrabutylammonium hydrogen sulfate under nitrogen. Heat the reactor to ~70° C., add 25.8 Kg (300 mols) of methyl acrylate over six hours, and then heat the reaction mixture at 70°–80° C. for at least 10 hours to form a product mixture containing a major amount of tetramethyl ester of 1,3,3,5-pentanetetracarboxylic acid, smaller amounts of pentamethyl and higher esters, and a minor amount of trimethyl ester of 1,1,3-propanetricarboxylic acid.

Charge 22 Kg (296 mols) of n-butanol and 30.3 Kg (296 mols) of n-hexanol to the reactor and heat at 110°–120° C. while collecting the volatiles overhead. After removing the stoichiometric amount of methanol, cool the reaction mixture to room temperature, dilute with toluene, wash to neutrality with water, dry by the azeotropic removal of water, and heat treat the crude under reduced pressure.

Distillation under reduced pressure (1 mmHg) and 200°–250° C. separates a lower viscosity oil which has a viscosity of 17 $mm^2 \cdot s^{-1}$ at 40° C. (hereinafter designated as PBE-17) and a bottoms product designated as PBE-25. PBE-25 is an oil having a viscosity of 24.8 $mm^2 \cdot s^{-1}$ at 40° C., a viscosity of 4.7 $mm^2 \cdot s^{-1}$ at 100° C., a viscosity index of 108, a total acid number of 0.034 mgKOH/g, a water content of 73 ppm, and total miscibility with R-1348 over a temperature range of –60° C. to 80° C.

EXAMPLE 2

Prepare several test compositions by blending four parts of R-134a with one part of ester lubricant consisting of Ernkarate DTDA (a di-tridecyl adipate sold by ICI) or a mixture thereof with the PBE-25 of Example 1. Then test the miscibility of each of the R-134a/lubricant blends at different temperatures, maintaining each of the temperatures for five minutes. The Emkarate DTDA/PBE-25 proportions used in preparing the lubricants and the results of the test are shown in Table I.

TABLE I

| Miscibility of R-134a/Emkarate DTDA Blends | | | | | | |
|---|---|---|---|---|---|---|
| Temp. | Emkarate DTDA/PBE-25 Proportions | | | | | |
| (°C.) | 100/0 | 60/40 | 50/50 | 40/60 | 30/70 | 20/80 |
| 70 | No | No | Yes | Yes | Yes | Yes |
| 25 | — | — | No | Yes | Yes | Yes |
| 15 | — | — | — | Yes | Yes | Yes |
| 10 | — | — | — | No | Yes | Yes |
| 5 | — | — | — | — | Yes | Yes |
| 0 | — | — | — | — | No | Yes |
| −15 | — | — | — | — | — | Yes |
| −20 | — | — | — | — | — | No |

EXAMPLE 3

Repeat Example 2 except for replacing the Emkarate DTDA with Hatcol 2911, an adipic ester of a mixture of 2-ethylhexanol and isodecanol, sold by Hatco Chemical Corp. The Hatcol 2911/PBE-25 proportions used in preparing the lubricants and the results of the test are shown in Table II.

TABLE II

| Miscibility of R-134a/Hatcol 2911 Blends | | | | | | |
|---|---|---|---|---|---|---|
| Temp. | Hatcol 2911/PBE-25 Proportions | | | | | |
| (°C.) | 100/0 | 60/40 | 50/50 | 40/60 | 30/70 | 20/80 |
| 70 | Yes | Yes | Yes | Yes | Yes | Yes |
| 5 | Yes | Yes | Yes | Yes | Yes | Yes |
| 0 | No | Yes | Yes | Yes | Yes | Yes |
| −15 | — | Yes | Yes | Yes | Yes | Yes |
| −20 | — | No | Yes | Yes | Yes | Yes |
| −25 | — | — | No | Yes | Yes | Yes |
| −30 | — | — | — | No | Yes | Yes |
| −35 | — | — | — | — | No | Yes |
| −50 | — | — | — | — | — | Yes |

EXAMPLE 4

Repeat Example 2 except for replacing the Ernkarate DTDA with Hatcol 2908, a di-2-ethylhexyl adipate sold by Hatco Chemical Corp. The Hatcol 2908/PBE-25 proportions used in pre, paring the lubricants and the results of the test are shown in Table III.

TABLE III

| Miscibility of R-134a/Hatcol 2908 Blends | | | | | | |
|---|---|---|---|---|---|---|
| Temp. | Hatcol 2908/PBE-25 Proportions | | | | | |
| (°C.) | 100/0 | 60/40 | 50/50 | 40/60 | 30/70 | 20/80 |
| 70 | Yes | Yes | Yes | Yes | Yes | Yes |
| −20 | Yes | Yes | Yes | Yes | Yes | Yes |
| −25 | No | Yes | Yes | Yes | Yes | Yes |
| −30 | — | Yes | Yes | Yes | Yes | Yes |
| −35 | — | No | No | Yes | Yes | Yes |
| −40 | — | — | — | No | No | Yes |
| −45 | — | — | — | — | — | No |

EXAMPLE 5

Repeat Example 2 except for replacing the Erakarate DTDA with Hatcol 2906, a di-isooctyl adipate sold by Hatco Chemical Corp. The Hatcol 2906/PBE-25 proportions used in preparing the lubricants and the results of the test are shown in Table IV.

TABLE IV

| Temp. | Miscibility of R-134a/Hatcol 2906 Blends | | | | | |
|---|---|---|---|---|---|---|
| | Hatcol 2906/PBE-25 Proportions | | | | | |
| (°C.) | 100/0 | 60/40 | 50/50 | 40/60 | 30/70 | 20/80 |
| 70 | Yes | Yes | Yes | Yes | Yes | Yes |
| −20 | Yes | Yes | Yes | Yes | Yes | Yes |
| −25 | No | Yes | Yes | Yes | Yes | Yes |
| −35 | — | Yes | Yes | Yes | Yes | Yes |
| −40 | — | No | Yes | Yes | Yes | Yes |
| −45 | — | — | No | No | Yes | Yes |
| −50 | — | — | — | — | No | No |

EXAMPLE 6

Repeat Example 2 except for replacing the Emkarate DTDA with Emkarate 911P, a phthalic ester of a mixture of nonanol and undecanol. The Emkarate 911P/PBE-25 proportions used in preparing the lubricants and the results of the test are shown in Table V.

TABLE V

| Temp. | Miscibility of R-134a/Emkarate 911P Blends | | | | | |
|---|---|---|---|---|---|---|
| | Emkarate 911P/PBE-25 Proportions | | | | | |
| (°C.) | 100/0 | 60/40 | 50/50 | 40/60 | 30/70 | 20/80 |
| 70 | No | No | Yes | Yes | Yes | Yes |
| 25 | — | — | No | Yes | Yes | Yes |
| 20 | — | — | — | No | Yes | Yes |
| 10 | — | — | — | — | Yes | Yes |
| 5 | — | — | — | — | No | Yes |
| −10 | — | — | — | — | — | Yes |
| −15 | — | — | — | — | — | No |

EXAMPLE 7

Repeat Example 2 except for replacing the Ernkarate DTDA with Hatcol 2938, a trimethylolpropane ester of a mixture of fatty acids containing 8–12 carbons. The Hatcol 2938/PBE-25 proportions used in preparing the lubricants and the results of the test are shown in Table VI.

TABLE VI

| Temp. | Miscibility of R-134a/Hatcol 2938 Blends | | | | | |
|---|---|---|---|---|---|---|
| | Hatcol 2938/PBE-25 Proportions | | | | | |
| (°C.) | 100/0 | 60/40 | 50/50 | 40/60 | 30/70 | 20/80 |
| 70 | No | Yes | Yes | Yes | Yes | Yes |
| 20 | — | Yes | Yes | Yes | Yes | Yes |
| 15 | — | No | Yes | Yes | Yes | Yes |
| 10 | — | — | No | Yes | Yes | Yes |
| 0 | — | — | — | Yes | Yes | Yes |
| −5 | — | — | — | No | Yes | Yes |
| −15 | — | — | — | — | Yes | Yes |
| −20 | — | — | — | — | No | Yes |
| −25 | — | — | — | — | — | Yes |
| −30 | — | — | — | — | — | No |

EXAMPLE 8

Repeat Example 2 except for replacing the Ernkarate DTDA with a butyrate of a mixture of dodecanol and octadecanol, designated as Butyrate-1218. The Butyrate-1218/PBE-25 proportions used in preparing the lubricants and the results of the test are shown in Table VII.

TABLE VII

| Temp. | Miscibility of R-134a/Butyrate-1218 Blends | | | |
|---|---|---|---|---|
| | Butyrate-1218/PBE-25 Proportions | | | |
| (°C.) | 60/40 | 50/50 | 40/60 | 30/70 |
| 70 | Yes | Yes | Yes | Yes |
| 5 | Yes | Yes | Yes | Yes |
| 0 | No | Yes | Yes | Yes |
| −5 | — | No | Yes | Yes |
| −10 | — | — | Yes | Yes |
| −15 | — | — | No | No |

EXAMPLE 9

Repeat Example 8 except for replacing the PBE-25 with PBE-17, the lower viscosity oil mentioned in Example 1. PBE-17 is an oil having a viscosity of 17 $mm^2 \cdot s^{-1}$ at 40° C., a viscosity of 3.6 $mm^2 \cdot s^{-1}$ at 100° C., a total acid number of 0.025 mgKOH/g, a water content of 64 ppm, and total miscibility with R-134a over a temperature range of −60° C. to 80° C. The Butyrate-1218/PBE-17 proportions used in preparing the lubricants and the results of the tests are shown in Table VIII.

TABLE VIII

| Temp. | Miscibility of R-134a/Butyrate-1218 Blends | | | |
|---|---|---|---|---|
| | Butyrate-1218/PBE-17 Proportions | | | |
| (°C.) | 60/40 | 50/50 | 40/60 | 30/70 |
| 70 | Yes | Yes | Yes | Yes |
| 0 | Yes | Yes | Yes | Yes |
| −5 | No | Yes | Yes | Yes |
| −10 | — | Yes | Yes | Yes |
| −15 | — | No | No | No |

What is claimed is:

1. A lubricant comprising (A) a first ester oil which lacks complete miscibility with fluorocarbons and which comprises at least one ester selected from the group consisting of alkyl alkanoates, alkyl diesters of dicarboxylic acids, neopolyol esters of fatty acids containing 8–20 carbons, diol esters, and carbonate esters and (B) a fluorohydrocarbon-miscibility-improving amount of a second ester oil which is different from the first ester oil and which is composed of molecules corresponding to the formula $ROOC—CH_2CH_2—[(ROOC)CHCH_2]_m—C(COOR)_2—[CH_2CH(COOR)]_n—CH_2CH_2COOR$ wherein the R's represent alkyl groups of 1–30 carbons, at least 10% of which are alkyl groups of 1–4 carbons; and each of m and n represents zero or a positive integer such that the sum of m and n in a molecule is 0–30; said fluorohydrocarbon-miscibility-improving amount of the second ester oil being sufficient to provide a second ester oil/first ester oil weight ratio of at least about 0.05/1.

2. The lubricant of claim 1 wherein the ratio is at least 0.1/1.

3. The lubricant of claim 2 wherein the ratio is 0.5–5.0/1.

4. The lubricant of claim 3 wherein the ratio is 1–5/1.

5. The lubricant of claim 1 wherein the sum of m and n in the molecules is an average of 1–10.

6. The lubricant of claim 5 wherein at least 20% of the alkyl groups in the second ester oil contain 1–4 carbons.

7. A refrigeration composition comprising a fluorohydrocarbon refrigerant and, as a refrigeration lubricant, a lubricant comprising (A) a first ester oil which lacks complete miscibility with fluorocarbons and which comprises at least one ester selected from the group consisting of alkyl alkanoates, alkyl diesters of dicarboxylic acids, neopolyol esters of fatty acids containing 8–20 carbons, diol esters, and carbonate esters and (B) a fluorohydrocarbon-miscibility-improving amount of a second ester oil which is different from the first ester oil and which is composed of molecules corresponding to the formula $ROOC—CH_2CH_2—[(ROOC)CHCH_2]_m—C(COOR)_2—[CH_2CH(COOR)]_n—CH_2CH_2COOR$ wherein the R's represent alkyl groups of 1–30 carbons, at least 10% of which are alkyl groups of 1–4 carbons; and each of m and n represents zero or a positive integer such that the sum of m and n in a molecule is 0–30; said fluorohydrocarbon-miscibility-improving amount of the second ester oil being sufficient to provide a second ester oil/first ester oil weight ratio of at least about 0.05/1.

8. The composition of claim 7 wherein the ratio is at least 0.1/1.

9. The composition of claim 8 wherein the ratio is 0.5–5/1.

10. The composition of claim 9 wherein the ratio is 1–5/1.

11. The composition of claim 7 wherein the sum of m and n in the molecules is an average of 1–10.

12. The composition of claim 11 wherein at least 20% of the alkyl groups in the second ester oil contain 1–4 carbons.

13. The composition of claim 7 wherein the fluorohydrocarbon refrigerant is 1,1,2,2-tetrafluoroethane.

* * * * *